US006076796A

United States Patent [19]

Huggins et al.

[11] Patent Number: 6,076,796

[45] **Date of Patent: *Jun. 20, 2000**

[54] OUTBOARD MOTOR/OUTDRIVE TRAVELING BRACKET

[76] Inventors: William Clarence Huggins, 1431 Dover Rd., Parker; Samuel T. Adams, 4612 Brook Forest Dr., Panama City, both of Fla. 32404

[ * ] Notice: This patent is subject to a terminal disclaimer.

[21] Appl. No.: 09/084,202

[22] Filed: May 26, 1998

Related U.S. Application Data

[63] Continuation-in-part of application No. 08/601,770, Feb. 15, 1996, Pat. No. 5,775,669.

[51] Int. Cl.[7] ..... F16M 1/00

[52] U.S. Cl. ..... 248/640; 248/351; 248/354.5; 440/55; 440/900

[58] Field of Search ..... 248/640, 641, 248/642, 351, 354.5, 643, 354.1, 354.6; 440/53, 55, 900

[56] References Cited

U.S. PATENT DOCUMENTS

| | | | |
|---|---|---|---|
| 2,977,084 | 3/1961 | Brown et al. | 248/642 X |
| 3,952,986 | 4/1976 | Wells | 248/642 X |
| 4,438,899 | 3/1984 | Perkins et al. | 248/351 X |
| 4,650,427 | 3/1987 | Huchinson | 440/55 |
| 4,651,964 | 3/1987 | Kendrick | 248/351 |
| 4,685,888 | 8/1987 | Brewer | 248/640 X |
| 4,828,186 | 5/1989 | Weiss | 248/640 |
| 4,842,239 | 6/1989 | Kinsey et al. | 248/640 |
| 5,393,251 | 2/1995 | Gilbert | 248/640 X |
| 5,525,082 | 6/1996 | Lee et al. | 248/642 X |
| 5,775,669 | 7/1998 | Huggins et al. | 248/640 |
| 5,888,109 | 3/1999 | Poll | 248/640 X |

*Primary Examiner*—Ramon O. Ramirez

[57] ABSTRACT

The bracket of this invention is to support an outboard motor or outdrive while being transported over the road on the stern of a boat. The bracket allows the foot or housing of the outboard motor or outdrive to be placed in such an up position so that it is not in danger of coming in contact with the surface of the roadway. The bracket also prevents excessive weight on and consequential damage to the hydraulic and manual tilt and support systems of the outboard motor or outdrive being transported. The bracket hangs from the factory-drilled holes in the outboard motor clamp brackets or outdrive brackets by means of a pin secured in place by quickly and easily removable click pins. When assembled, the bracket-forms a rigid support between the stern of a boat and the foot or shaft housing of the motor or outdrive being transported.

4 Claims, 4 Drawing Sheets

OUTBOARD MOTOR/OUTDRIVE TRAVELING BRACKET

CROSS REFERENCE

This is a Continuation in Part (C-I-P) of application Ser. No. 08/601,770 filed Feb. 15, 1996, now U.S. Pat. No. 5,775,669.

BACKGROUND OF THE INVENTION

1. Field of the Invention

This invention pertains to an outboard motor/outdrive traveling bracket for use to support an outboard motor or an outdrive (also known as a stern drive) while in over the road transportation on the stern of a boat. All references to an "outboard motor" or "motor" would also apply to an outdrive. The bracket provides support between the shaft housing or an outboard motor/outdrive and the stern of a boat. Thus, a depiction of the invention in use with an outboard motor would be essentially the same as with an outdrive.

2 Background of the Prior Art

Prior art U.S. Pat. No. 4,651,964 shows a device supported on a motor clamp bracket 27 by pins 43, 47 and 49. U.S. Pat. No. 4,438,899 discloses a bracket 1 for attachment to arms 27 and member 37. U.S. Pat. No. 4,685,888 shows a motor support 18 having a V-section 50 for supporting a motor staff 20. The end 18 is attached to a trailer 12.

SUMMARY OF THE INVENTION

There is a need for an inexpensive yet effective support bracket to maintain an outboard motor in an upward tilted position while being transported over the road on the stern of a boat.

It is an object of this invention to provide a simple inexpensive bracket which is easily installed without the need for any particular tools.

It is another object of this invention to provide an outboard motor support bracket which may be adjusted to transport the lower unit at the desired height above the roadway depending on the height of the trailer bed.

It is another object of this invention to provide an outboard motor support bracket having a pair of parallel movable bars which are adjustable to vary the distance between a motor engaging yoke and a stern engaging plate whereby the bracket is adjustable to different lengths. A non-adjustable version of the invention would be configured to accommodate outboard motors of specific sizes or makes.

And yet another object of this invention is to provide an outboard motor support bracket having means to suspend the bracket from existing factory installed motor clamp/adjustment bracket.

Another object of this invention is to provide a support bracket having telescoping members which permit adjusting the length of the bracket of accommodate different sizes of outboard motors.

And it is another object of this invention to provide a rod adjustably engaging the telescoping members and having a pin movable in a ring on the rod whereby the pin is adapted to engage a clamp bracket on the outboard motor.

It is seen that the rod is adjustable along the length of the telescoping members and is held in place by securing devices. The rod has a ring for supporting the rod in any number of adjustable positions.

These and other objects of this invention will become more apparent to those skilled in the art to which the invention pertains from a reading of the following specification when taken with the annexed drawings.

DETAILED DESCRIPTION OF THE PREFERRED EMBODIMENT OF THE INVENTION

Figure 1:
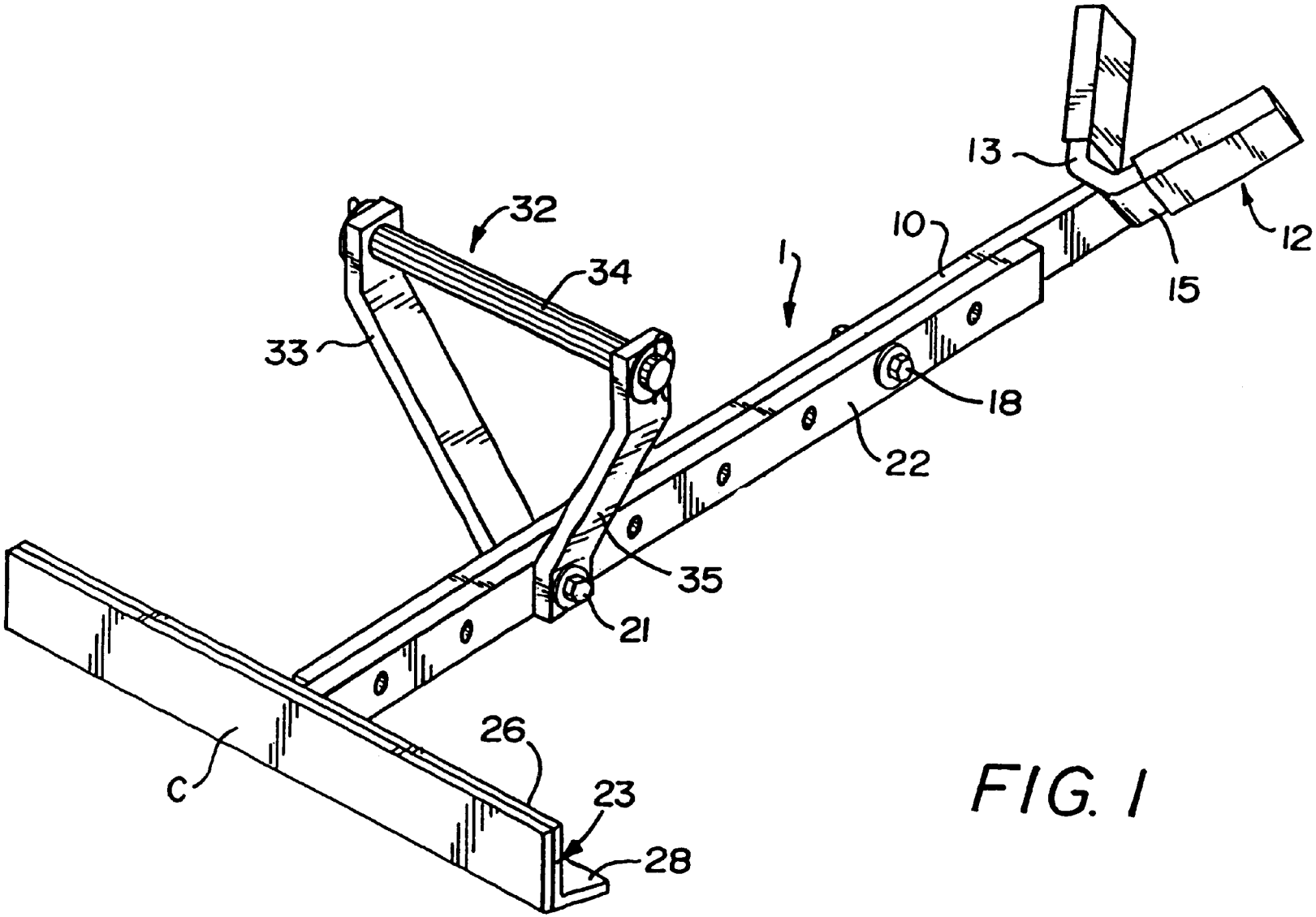
FIG. 1 is a perspective view of the outboard motor support bracket.
Figure 2:
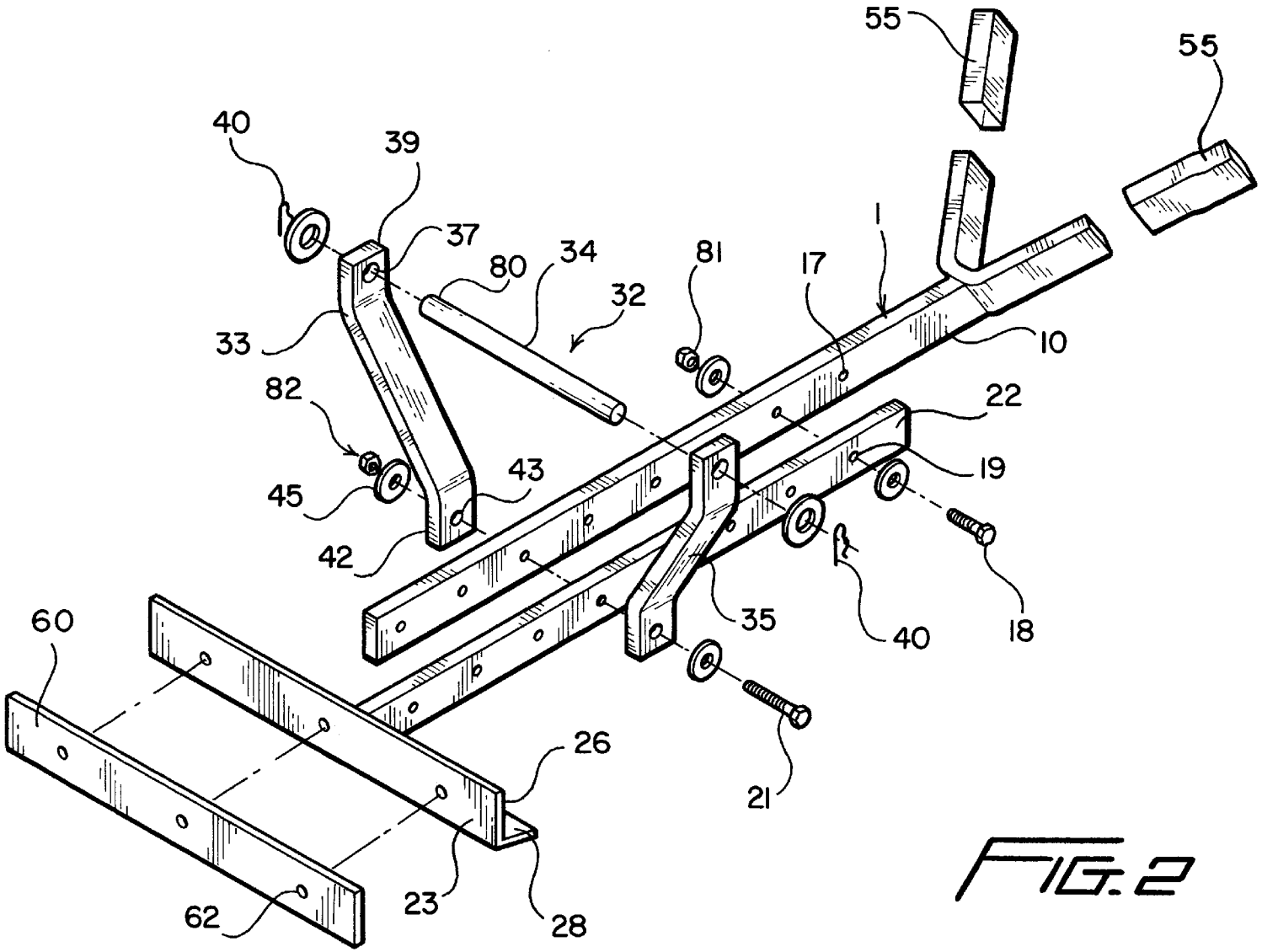
FIG. 2 is a perspective exploded view of the motor support bracket components.

The bracket 1 has first extension bar 10 having a cradle yoke 12 at one end. The length and other dimensions of the bar 10 and yoke 12 will vary with the size and make of the outboard motor or outdrive to be supported by the bracket 1. The cradle yoke 12 attached at the end of the extension bar 10 has a pair of diverging legs 13 and 15 designed to cradle and support the shaft housing 20 of an outboard motor 30 or outdrive above the lower gear casing, FIG. 3. The extension bar 10 has adjustment holes 17 along approximately eighty percent of its length as shown. The diameter, number and placement of the holes 17 will vary according to the size and make of the outboard motor or outdrive to be supported by the bracket. The first extension bar 10 is designed to interlock with a second extension bar 22 having a stern plate 23.

Figure 3:
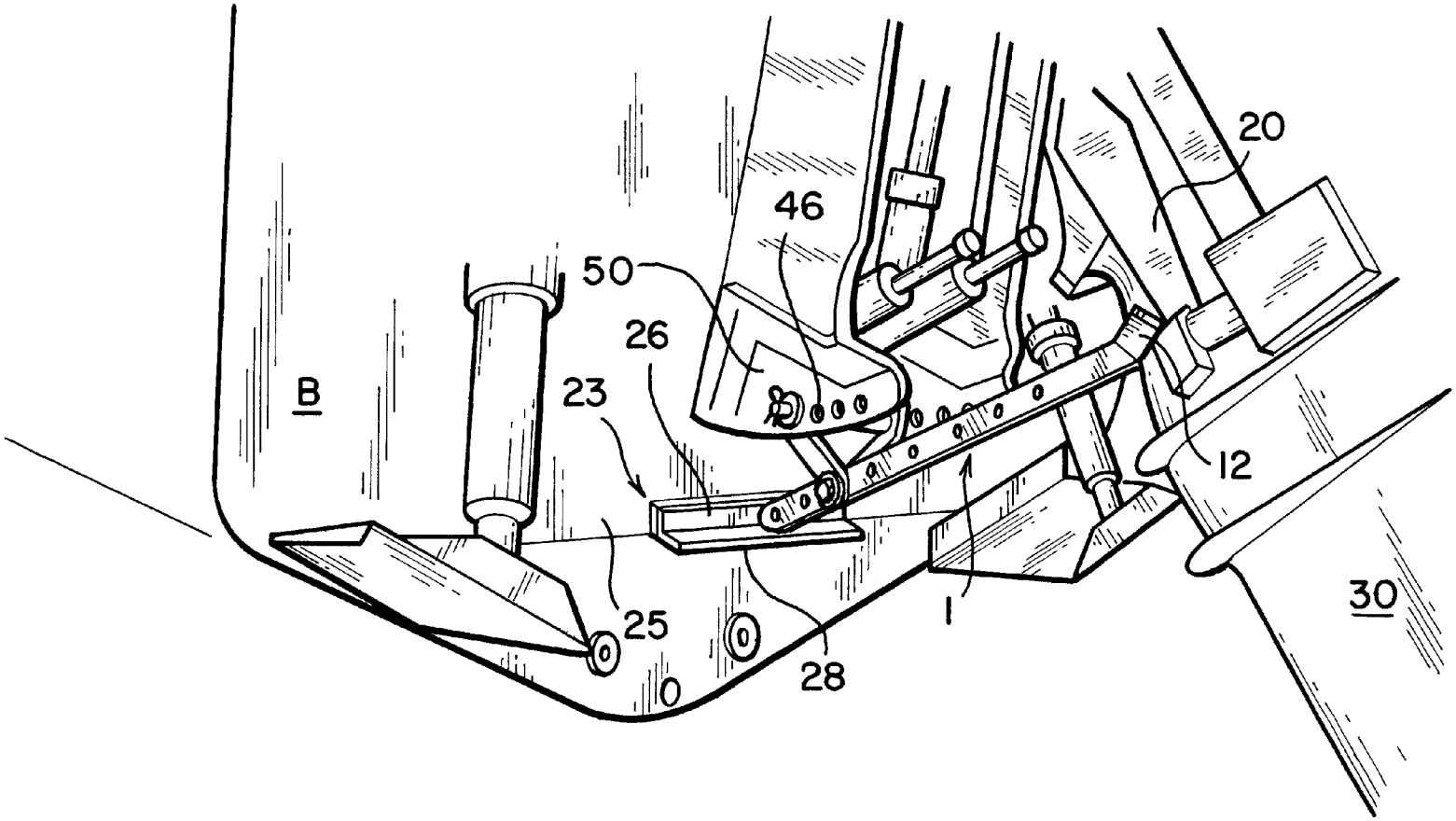
FIG. 3 is a perspective view of the bracket supporting an outboard motor.

The second extension bar 22 with stern plate 23 at the end thereof is designed to interlock with the first extension bar 10 and the cradle yoke 12 by means of adjustment holes 19 cooperating with holes 17. These will vary in diameter, placement and number depending on the size and make of the outboard motor or outdrive to be supported by the Bracket. The length and thickness of the stern plate 23 will vary according to the size of weight of the outboard motor or outdrive to be supported. The stern plate 23 is configured in the same matter as a standard angle iron with its opposing surfaces 26 and 28 at ninety degree angles to one another as shown. One surface 26 of the stern plate 23 will rest flush against the stern 25 of the boat B when the bracket 1 is in its properly-adjusted traveling position as shown in FIG. 3. The other surface 28 of the stern plate 23 will extend away from the stern at a ninety degree angle. The end of extension bar 22 is attached to the center C of the stern plate so as to maintain an optimum balance.

It will be understood that the first extension bar 10 is slideably adjustable lenghtwise along the second extension bar 22. The adjustment is made by means of nut and bolt fastener 18 and 21.

A drop bar suspension member 32 has opposing legs 33 and 35 separated by a pin 34. It is seen that the pin 34 extends through holes 37 in the tops 39 of the legs 33 and 35 and is held in place by fastener clips 40. The diameter of the holes 37 will vary depending on the diameter of the drop bar pin 34. The bottom 42 of the drop bar leg 32 has holes 43 which accommodate a drop bar lock bolt 21. The diameter of the holes 43 will vary depending on the diameter of the drop bar lock bolt 21. The holes 43 are designed to line up with holes 17 and 19 in the extension bars 10 and 22, and locked together by the fastener bolts 18 and 21 at the desired length.

The drop bar pin 34 extends through any of several different sets of factory-drilled holes 46 in the previously installed outboard motor clamp/adjustment bracket 50, FIG. 3, or outdrive bracket. The factory-drilled holes 46 are used to position the angle between the stern of the boat and the foot or housing 20 of the outboard motor or outdrive when the motor/outdrive is in its running in-water position. The length and diameter of the drop bar pin 34 varies with the diameter of the factory-drilled adjustment holes 46 in the outboard motor clamp bracket 50 or outdrive and the distance between those holes. The bracket 1 is suspended from the outboard motor clamp/adjustment bracket 50 by the drop bar pin 34 extending through the factory-drilled adjustment holes 46 and the holes 37 at the top 39 of the drop bar arms 33 and 35.

A stern plate pad 60 is affixed to the outer surface of the stern plate 23. The pad 60 rests against the stern 25 of the boat B, FIG. 3. The stern plate pad 60 is attached to the stern plate 23 by means of recessed fasteners 62 which do not contact the stern 25 of the boat B. The stern plate pad is made of pliable material such as rubber, vinyl or plastic which will not damage the stern or mar its finish. The stern plate pad 60 protects the stern 25 of the boat B from contact with the stern plate metal 23.

Cradle pads 55 fit over the ends of the cradle yoke arms 13 and 15 of the extension bar 10 as shown. The pads are made of pliable material such as vinyl, rubber or plastic, which will not damage or mar the housing of the outboard motor or outdrive being supported by the yoke 12. The size of the cradle pads will vary in accordance with the size of the cradle yoke. The cradle pads will prevent contact between the foot or housing 20 of the outboard motor or outdrive being supported and the cradle yoke metal.

The fasteners 40 are click pins and extend through holes 80 at each end of the drop bar pin 34. The fastener pins 40 are configured so that the straight side of the pin extends through the hole 80 and the opposite side of the pin is curved and locks around the drop bar pin to keep the pin in place. The holes 80 in the drop bar pin are located so that they are on the outside of the drop bar legs 33 and 35 when the bracket is assembled and in travelling position.

The lock nuts 81 and 82, respectively, secure the threaded ends of the drop bar lock bolt 18 and extension bar lock bolt 21.

Bolts 18 and 21 extend through holes 17 and 19 of the extension bars with bolt 21 also extending through the bottom holes 43 of the drop bar to position the length of the combined bars 10 and 12 at the desired length, depending on the make of the outboard motor or outdrive and the desired traveling height of the foot of the outboard motor or outdrive being transported. The length and diameter of the drop bar lock bolts 18 and 21 will vary depending on the thickness of the assembled extension bar and the drop bar and the weight of the outboard motor or outdrive to be transported. It is seen that the bolts lock components 10 and 22, and legs 33 and 35 together at the desired position to transport the outboard motor/outdrive over the road.

Once the drop bar lock bolts 18 and 21 are in place, they serve to make he extendible bars 10 and 22 of the bracket rigid.

Washers 45 are placed on either end of the drop bar pin 34 between the click pins 40 and the outer surface of the legs 33 and 35. This will prevent direct contact between the outer surface of the outboard motor clamp/adjustment bracket or the outdrive bracket and the click pins 40 to avoid excessive pressure on the sides of the click pins.

The bracket 1 is to support an outboard motor or outdrive while being transported over the road on the stern of a boat. The bracket allows the foot or housing 20 of the outboard motor 30 or outdrive to be placed in such an up position so that it is not in danger of coming in contact with the surface of the roadway. The bracket also prevents excessive weight on and consequential damage to the hydraulic and manual tilt and support systems of the outboard motor or outdrive being transported. The bracket hangs from the factory-drilled holes 46 in the outboard motor clamp bracket 50 or outdrive bracket by means of a drop bar pin 34 secured in place by quickly and easily removable click pins 40. When assembled, the bracket forms a rigid support between the stern 25 of the boat B and the foot or housing 20 of the motor or outdrive being transported The length of the extension bars 10 and 22 which supports the motor or outdrive can be varied by use of the adjustment holes 17 and 19 which are placed at varying distances along the length of the extension bars. This enables the user to adjust the length of the bracket bars 10 and 22 in accordance with the make or size of the outboard motor or outdrive and the height or angle at which the user desires to transport the foot or housing of the outboard motor or outdrive above the road surface, depending on the height of the particular boat trailer being utilized. The weight of the outboard motor or outdrive in its traveling up position is distributed against the stern of the boat instead of on the motor or outdrive's internal hydraulic and manual tilt and trim systems. Many outboard motors have a built-in arm or bracket which supports the motor in its most upright position. However, this factory-installed arm or bracket is not designed to support the motor in an upright position during transportation on a trailer behind a motor vehicle, and may bend and break off if used for this purpose. The bracket can be installed and removed in seconds without any tools simply by inserting or removing the click pins 40 into or out of its hole in the drop bar pin 34. The bracket 1 does not depend for its support or positioning on any part of the boat trailer or anything external to the boat and the motor or outdrive. A tie-down strap can be extended around the foot of the motor or outdrive and affixed to unused holes 17 and 19 in the extension bar below the yoke to prevent the outboard motor or outdrive from bouncing in the cradle yoke 12 on the extension bar 10. The bracket and its component parts (except the stern plate pad and the cradle pads) can be constructed of aluminum, steel, stainless steel or any other metallic material of sufficient strength to support the size outboard motor or outdrive being transported. The size and dimensions of the bracket assembly and its components will vary according to the size, weight and make of the motor or outdrive being transported.

Figure 5:
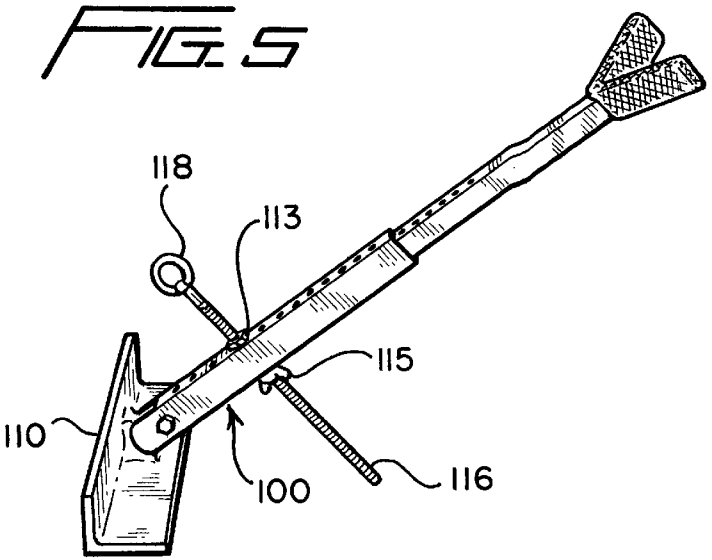
FIG. 5 is a side elevational view of the bracket in assembled position.
Figure 6:
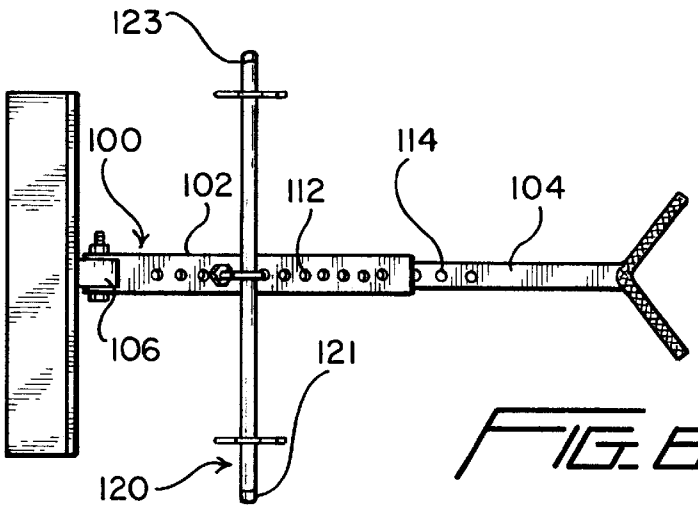
FIG. 6 is a front elevational view of the bracket showing the assembled bracket with adjustable pin engaged between spaced apart motor brackets.
Figure 4:
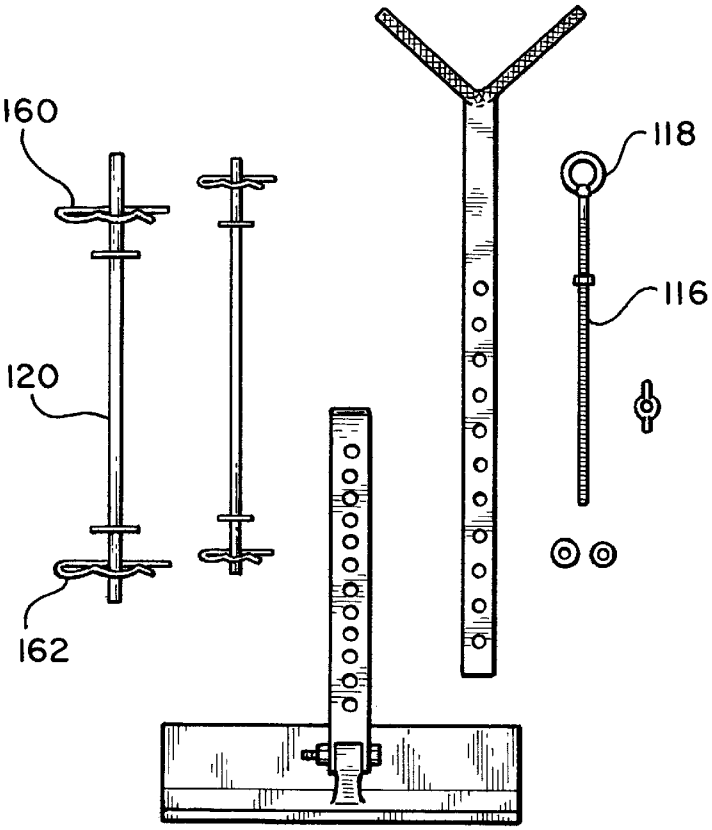
FIG. 4 is a plan view of the components of the bracket.

Another embodiment of the support bracket is shown in FIGS. 4–6. The bracket 100, FIG. 6, comprises telescoping members 102 and 104 which permit adjusting the bracket 100 lengthwise between stern bracket 110 and yoke 117 to accommodate outboard motors of different size. It will be understood that the bracket 100, FIGS. 4–6, is substituted for the bracket 1 of FIG. 3

The members 102 and 104 have a series of apertures 112 and 114 for receiving a rod 116. The rod 116 is held on one or both of the members 102 and 104 by fasteners 113 and 115. As is evident, the rod 116 may be adjusted along the length of members 102 and 104. The rod 116 has a ring 118 for receiving a support pin 120. The pin 120 is slideably adjustable in the ring 118 as seen in FIGS. 5 and 6 and the ends 121 and 123 received in any of the series of holes 146 and 148 in the motor clamp brackets 150 and 152. The motor clamp brackets 150 and 152 are identical and are spaced apart from each other. Fastening members 160 and 162, FIG. 4, secure the pin 120 to the clamp, bracket, 150 and 152.

What is claimed is:

1. A bracket for supporting an outboard motor, including a first extension bar, a second extension bar, a yoke on the first extension bar, a support plate on the second extension bar, adjusting means slidably attaching said second extension bar to said first extension bar for varying the distance between said yoke and said support plate, a single rod member extending upwardly from at least one of said first and second extension bars, a single support member attached to said single rod member and extending transversely therefrom, whereby the support plate is adapted to rest said a stern of a boat, the yoke is adapted to be attached to said outboard motor with the single support member adapted to be connected to a bracket on the motor for supporting the motor in a tilted position.

2. The bracket of claim 1 wherein said single rod member is adjustably attached to at least one of said first and second extension bars and wherein said single support member includes a pin removably attached to said rod member adapted to engage a motor bracket.

3. The bracket of claim 2, wherein said motor bracket is comprised of spaced platens with the said pin adapted to engage the same.

4. The bracket of claim 2 wherein said single rod member is formed with an opening and said pin extends therethrough.

* * * * *